United States Patent [19]

Bredeweg

[11] 4,371,971

[45] Feb. 1, 1983

[54] SAMPLE LOADING MECHANISM

[75] Inventor: Roger L. Bredeweg, Stevensville, Mich.

[73] Assignee: Leco Corporation, St. Joseph, Mich.

[21] Appl. No.: 149,916

[22] Filed: May 15, 1980

[51] Int. Cl.[3] ..... F27D 3/00; F27D 11/04

[52] U.S. Cl. ..... 373/115; 373/118; 219/426; 222/503; 414/199

[58] Field of Search ..... 13/20, 23, 25, 33; 219/426, 427; 422/63, 65; 414/199; 222/502, 503; 23/230 PC; 373/115, 118

[56] References Cited

U.S. PATENT DOCUMENTS

| | | | |
|---|---|---|---|
| 1,585,120 | 5/1926 | Seavers | 222/502 |
| 1,850,589 | 3/1932 | Tourneau | 222/502 |
| 2,636,648 | 4/1953 | Richardson | 222/502 |
| 2,836,332 | 5/1958 | Standish et al. | 222/502 |
| 2,901,148 | 8/1959 | Cunningham et al. | 222/502 |
| 3,936,587 | 2/1976 | Sitek et al. | 13/23 |
| 4,056,677 | 11/1977 | Berk et al. | 13/23 |

FOREIGN PATENT DOCUMENTS

| | | | |
|---|---|---|---|
| 404883 | 7/1943 | Italy | 13/33 |

*Primary Examiner*—Bernard Roskoski

*Attorney, Agent, or Firm*—Price, Heneveld, Huizenga & Cooper

[57] ABSTRACT

A sample loading mechanism includes a hopper mounted to a base for positioning the hopper with respect to a furnace for releasably holding a relatively small sample in relation to a crucible used with the furnace. The hopper includes a floor with a movable element for alternately closing the floor for holding the sample and opening the floor permitting the sample to drop into the crucible. A plate is slideably mounted to the base above the hopper and includes an aperture which aligns with the hopper in a first position for admitting a sample to the hopper and is slideable to a second position for selectively sealing the upper end of the hopper. An actuator is provided for selectively controlling the movable element of the hopper for dropping the sample into a crucible aligned below the hopper.

8 Claims, 10 Drawing Figures

SAMPLE LOADING MECHANISM

BACKGROUND OF THE INVENTION

The present invention relates to a sample loading mechanism and particularly to apparatus for loading small samples into crucibles employed with a furnace for combusting the samples into constitute gases for subsequent analysis.

In furnaces employed for combusting relatively small (½ to 1 gram) samples of, for example, steel, typically resistance or induction furnaces are employed. Graphic crucibles are employed for resistance heating of the crucible directly when placed between a pair of electrodes. Ceramic crucibles are typically employed when a specimen is heated by an induction field provided by an activated coil surrounding the crucible. In both combustion furnaces, it is necessary to initially outgas the crucible to assure no contaminate gases are mixed with the specimen gases resulting from the combustion of the sample. With manual loading of crucibles, it is necessary in the prior art systems to open the combustion chamber after the outgasing of the crucible to gain access to the crucible to insert the sample. When doing so, however, the crucible is exposed to atmospheric gases which can contaminate the crucible to an extent that the analytical results can be adversely affected.

In order to prevent the re-exposure of an outgassed crucible to atmospheric conditions, automatic sample loading mechanisms have been attempted. One such attempt includes a sample holding cup formed in a rotatable carrier rod which seals an opening in an upper electrode of a resistance furnace which communicates with the crucible. The rotatable cup including rod, is rotated 180° to in effect dump the sample out and downwardly into the mouth of the crucible. The operation of such a device was not proven to be satisfactory inasmuch as the rotation of the rod tended to throw the sample outwardly from the loading mechanism due to the centrifugal force applied to the sample when the cup was rotated. The result either caused jamming of the rotatable loading mechanism by the specimen or the sample would not be dropped into the crucible.

SUMMARY OF THE PRESENT INVENTION

The present invention overcomes the difficulties of the prior art by providing a sample loading mechanism providing for the automatic dropping of a sample directly downwardly into the open crucible by employing hopper means with at least one movable member for alternately holding a sample in position and movable to release the sample and thus drop the sample into the crucible.

In the preferred embodiment of the present invention the sample loading mechanism includes a base with an aperture extending therethrough and adapted to communicate with the open end of a crucible, and a sample releasing means positioned in alignment with the aperture of the base and including hopper means having at least one movable element movable between a first position for holding the sample in the hopper and a second position releasing the sample from the hopper. In one embodiment of the present invention, the sample releasing means includes a member movable with respect to the base and hopper means for sealing the aperture extending through the base during combustion of the sample subsequent to dropping of the sample into the crucible.

These and other features, advantages and objects of the present invention will become apparent upon reading the following description thereof together with reference to the accompanying drawing in which:

DETAILED DESCRIPTION OF THE PREFERRED EMBODIMENT

Figure 1:
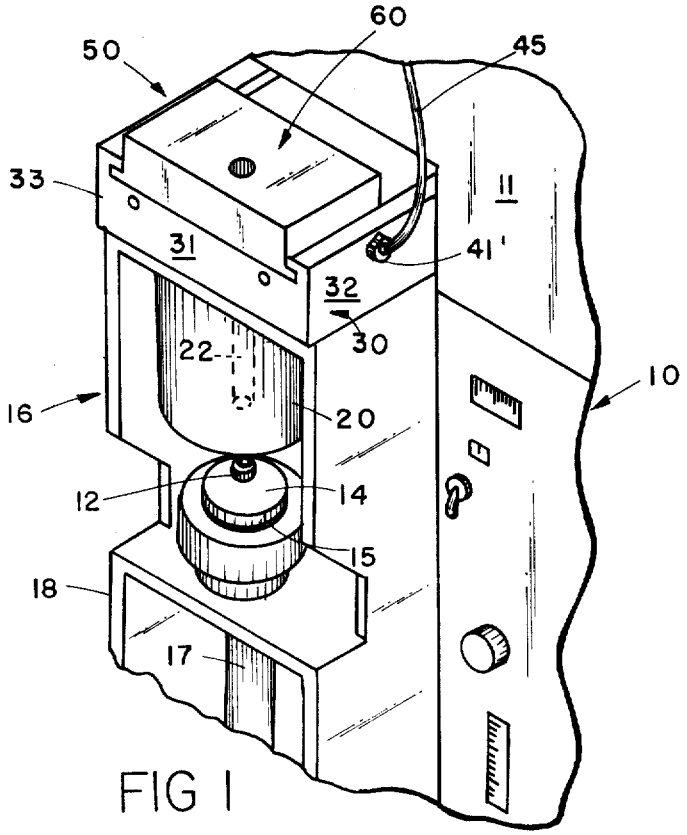
FIG. 1 is a fragmentary perspective view of an analyzer including a combustion furnace and the sample loading mechanism of the present invention.

Referring initially to FIG. 1 there is shown an analyzer 10 for analyzing the gaseous byproducts of combustion of solid specimens or samples positioned in a graphite crucible 12 resting on a movable lower electrode 14 associated with a resistance furnace 16 integral with the analyzer. Furnace 16 includes a housing 18 to which there is fixedly mounted an upper electrode 20 having a central axially extending aperture 22 communicating with the open mouth of crucible 12 permitting samples to be dropped therein from the sample loading mechanism 50 mounted on top of housing 18. Lower electrode 14 is vertically movable between an open position shown in FIG. 1 to a closed position in which an O-ring seal 15 surrounding the outer circumferential diameter of electrode 14 sealably engages an inter-cylindrical wall of fixed electrode 20. Crucible 12 is held in electrical contact between the upper and lower conductive electrodes 14 and 20. A electrode 14 is coupled to a cylinder 17 for providing the desired vertical movement of the electrode from the open position shown in FIG. 1 to a closed operating position.

The furnace electrodes may be of the construction disclosed in greater detail in U.S. Pat. No. 4,056,677 issued Nov. 1, 1977, and assigned to the present assignee, the disclosure of which is incorporated herein by reference. In the preferred embodiment of the invention as shown in FIG. 1 the upper electrode is a single element as opposed to a two section element as disclosed in the above identified patent. Analyzer 10 can be any one of a number of analyzers commercially available from the assignee of the present invention and known generally as model No. TC-36, TN-15, RO-17 or RO-18. Crucible 12 can generally be of the type disclosed in U.S. Pat. No. 3,889,627, issued Aug. 12, 1975 and assigned to the present assignee.

Figure 4:
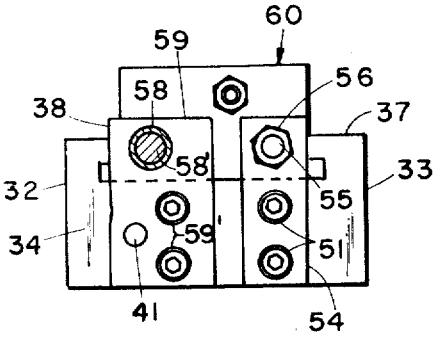
FIG. 4 is a right end elevational view of the structure shown in FIG. 2.
Figure 7:
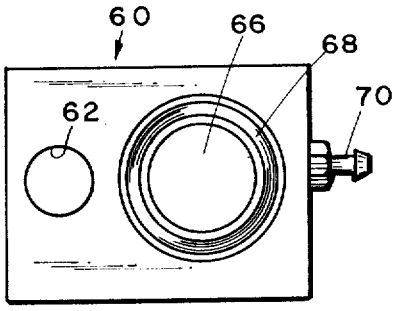
FIG. 7 is a bottom plan view of a portion of the sample loading mechanism of the present invention.

The sample loading mechanism as seen in FIG. 1 includes a stationary base 30 which is secured to the upper surface of housing 18 by conventional fastening means. Base 30 includes a forward wall 31, sidewalls 32 and 33, and a rear wall 34 (FIG. 2) and extends rearwardly into the cabinet 11 of the analyzer. Base 30 further includes a substantially flat floor 35 and an upper surface 36. The edges of base 30 integrally include upperwardly and inwardly projecting L-shaped flanges 37 and 38 for captively receiving a slide member 60 as best seen in FIGS. 1 and 4.

Base 30 includes aperture means 40 extending downwardly therethrough and positioned forwardly on the fore to aft centerline of the base. Aperture means 40 includes an upper generally rectangular portion 42 extending downwardly through surface 36, the floor which communicates with an inwardly tapered conical or funnel-shaped portion 44 extending through the floor 35 of the base and aligned above the open upper end of aperture 22 formed in upper electrode 20 and through the top of housing 18. As described in greater detail herein, aperture means 40, and particularly the upper portion 42 thereof, houses the sample dropping hopper means 80. Extending laterally outwardly and downwardly into the top surface 36 of base 30 from the edges of the upper portion 42 of aperture 40 are a pair of V-shaped recesses 46 and 47 with each recess having inwardly converging lands 48 (FIG. 9) terminating in an apex 49 for purposes of pivotally receiving and supporting the outwardly projecting ears 92 and 94 associated with a movable jaw 86 of the sample dropping hopper means 80 as described more fully below.

Figure 10:
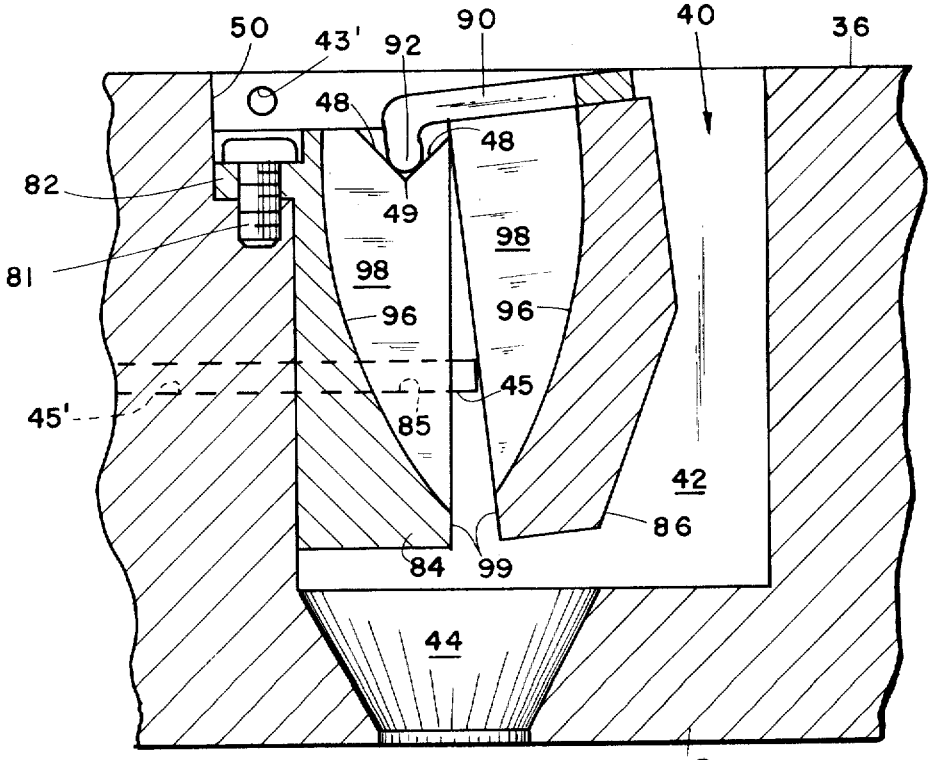
FIG. 10 is an enlarged cross-sectional view of the structure as shown in FIG. 9, only shown in a second position.

Formed laterally through sidewall 32 of the base and extending through an edge of the upper portion 42 of aperture means 40 is a conduit 43 to which a carrier gas supply line 45 is coupled by means of a suitable fitting 41' as seen in FIG. 1. Conduit 43 terminates in an opening 43' as seen in FIG. 9 and 10 for supplying, as described more fully hereinafter, a carrier gas which flows downwardly through the opening 44 into conduit 22 of electrode 20 and into the open mouth of crucible 12.

Figure 9:
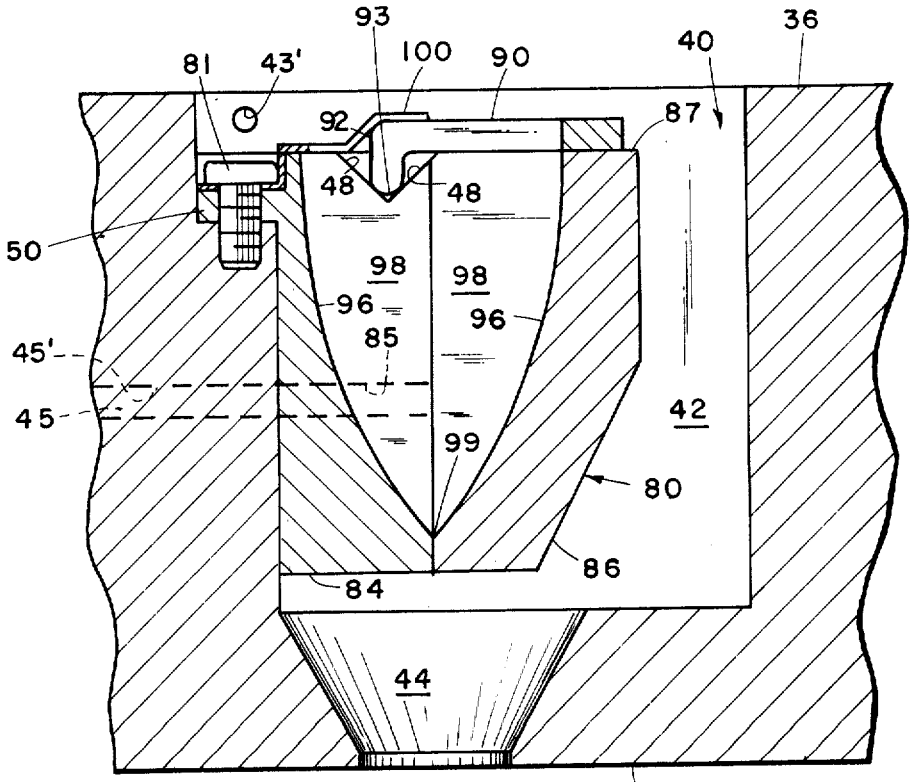
FIG. 9 is an enlarged fragmentary cross-sectional view of the structure shown in FIG. 8, taken along the section lines IX—IX of FIG. 8.

Base 30 further includes a laterally extending ledge 50 as best seen in FIG. 9 which extends along the forward edge of aperture 40 below opening 43' for receiving and supporting thereon member 84 of the sample hopper 80. As best seen in FIGS. 2 through 5, secured to the rear wall 34 of base 30 is a first support plate 54 for supporting therein a threaded stop screw 55 held in position by a lock nut 56. The forwardly extending end 57 of lock screw 56 serves as a rear stop for slide member 60. Bracket 54 is secured to base 30 by means of bolts 51 (FIG. 4).

Figure 2:
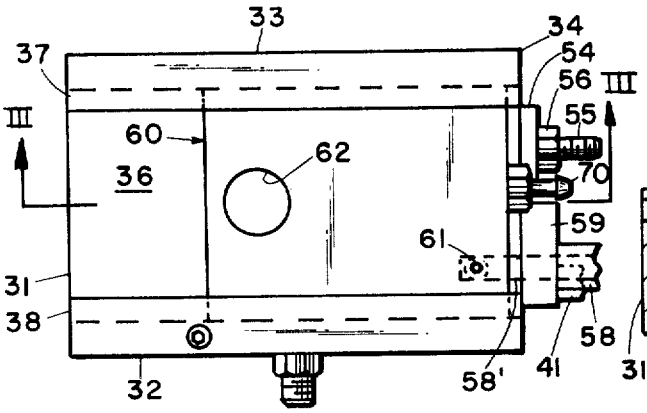
FIG. 2 is a plan view of the sample loading mechanism of the present invention shown in a first position.

Spaced from bracket 54 is a second bracket 59 secured to the rear wall 34 of the base by means of bolts 59' as seen in FIG. 4. A pneumatically operated cylinder 58 is coupled to bracket 59 and includes a shaft 58' secured to slide 60 by means of a set screw 61. Thus, by actuation of the double acting cylinder 58, slide 60 can be moved to a forward position shown in FIG. 5 with shaft 58' extended, or to a rearward position against stop 57 as shown in FIG. 2 with shaft 58' retracted.

Slide 60 provides two functions. When in the rearward position, shown in FIGS. 2 and 3, it provides a communication path for positioning samples within the sample receiving hopper 80. When in the forward position, shown in FIGS. 5 and 6, it seals the open top of aperture means 40 to enclose the upper end of the furnace during combustion of a sample. Also coupled to mounting plate 59 is a spring loaded single acting pneumatic cylinder 41 (FIGS. 2, 4 and 5) having a control shaft 45 (FIGS. 8, 9, and 10) extending through aperture 45' formed in base 30. The control rod 45 also extends through an aperture 85 in the hopper means 80 for engaging and controlling a movable member 86 of the hopper means as described in detail below. Cylinder 58 is a two-way acting cylinder controlled by suitable valve means while cylinder 41 is a spring loaded single acting cylinder which when shaft 45 is in a retracted position shown in FIG. 9 and when extended is in a position shown in FIG. 10.

Figure 3:
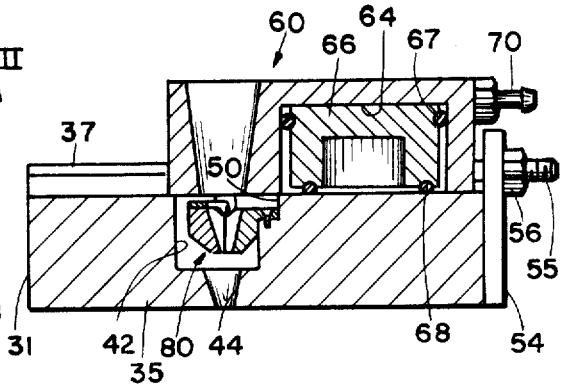
FIG. 3 is a cross-sectional view of the structure shown in FIG. 2 taken along section lines III—III of FIG. 2.
Figure 6:
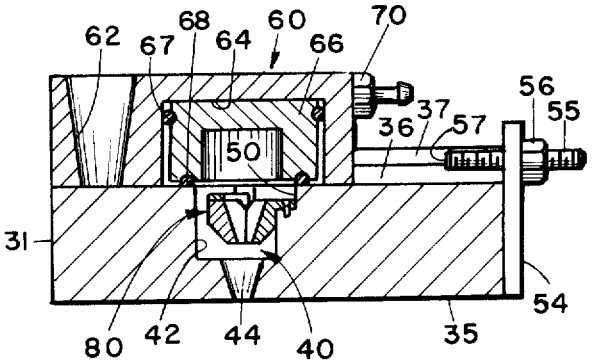
FIG. 6 is a cross-sectional view of the structure shown in FIG. 5 taken along the section lines VI—VI of FIG. 5.

Sliding plate 60 includes a downwardly projecting inwardly tapered aperture 62 (FIG. 27) formed therethrough and located on the centerline of the plate near the forward end. The lower end of aperture 62 is, in the position shown in FIG. 3, aligned directly above hopper means 80 associated with the mounting plate 30 for positioning a sample dropped into the upper end of the aperture into the hopper means. Formed upperwardly through plate 60 toward the rear portion is a cylindrical cup-shaped aperture 64 for receiving therein an inverted cup-shaped piston 66. Piston 66 has an O-ring seal 67 extending around the outer periphery thereof near the top sealably engaging cylindrical wall of cup-shaped aperture 64. Along the lower annular surface of the cup-shaped piston 66, there is positioned a second O-ring 68 positioned in an annular recess and having a diameter sufficient to surround and enclose the rectangular aperture means 40 formed through the base 30 as best seen in FIG. 6. Communicating with the annular chamber defined by the space between the outer peripheral cylindrical surface of piston 66 and the inner cylindrical wall of aperture 64 is an air inlet 70 which is coupled by hose means (not shown) to a supply of pressurized air for forcing the piston 66 downwardly into sealing engagement with the top surface 36 of base 30 when in the position shown in FIG. 6. When the sliding plate 60 is to be moved, pressure applied to fitting 70 is relieved thereby permitting the sliding of the plate with relative ease into a sample loading position as shown in FIG. 3.

Figure 8:
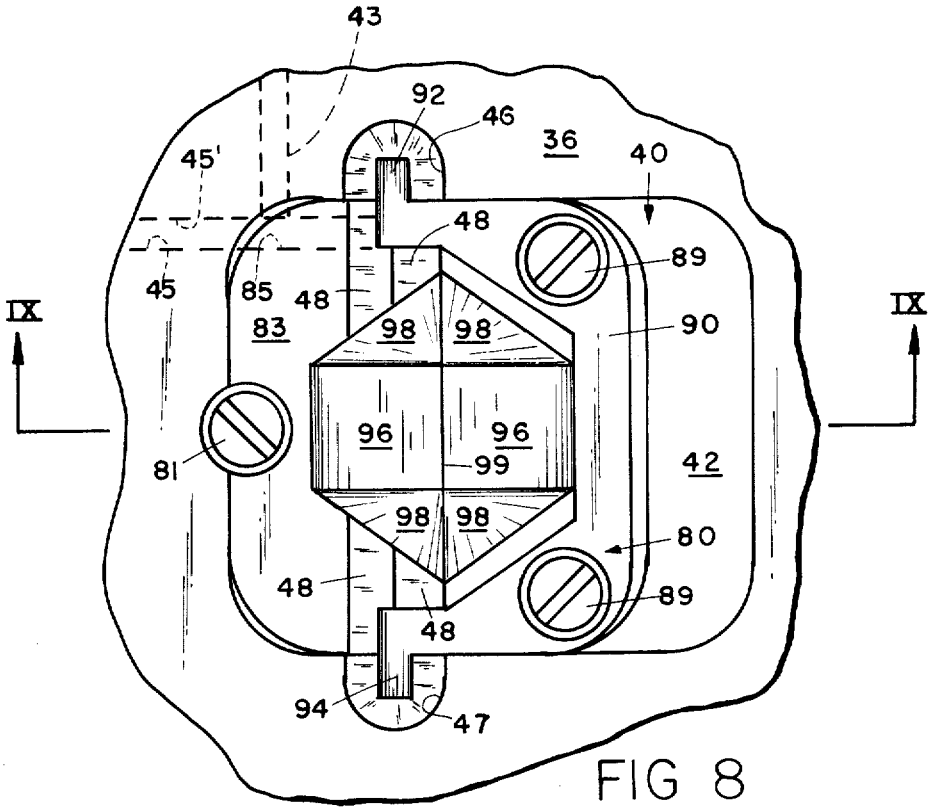
FIG. 8 is an enlarged fragmentary plan view of a portion of the structure shown in FIGS. 1 through 6 shown in a first position.

The hopper mechanism 80 is best seen in FIGS. 8 through 10 and is mounted to base 30 by means of an elongated rectangular projection 82 which is integrally formed to extend outwardly from near the top of the wall of a first or fixed jaw member 84. The fixed jaw member 84 is secured to the base by means of a fastener such as screw 81 which extends downwardly through leg 82 into the floor of the L-shaped recess 50 of the base. A second movable jaw member 86 is pivotally mounted to the first jaw member and to the base by means of a U-shaped bracket 90 as seen in FIG. 8 which includes a pair of downwardly and outwardly projecting ears 92 and 94 having rounded tips 93 which seatably fit within the V-shaped recesses 46 and 47 respectively of the base member and which rests against the lands 48 therein as best seen in FIGS. 9 and 10. The V-shaped recesses also extend through the upper surface 83 of jaw member 84 as best seen in FIG. 8. Bracket 90 is mounted to the upper surface 87 of movable jaw 86 by means of a pair of space fasteners such as screws 89. Jaw member 84 includes an aperture 85 aligned with aperture 45' of base 30 for receiving therethrough the control rod 45 permitting the rod to engage the edge of movable jaw member 86.

Each of the jaws 84 and 86 are formed to include a centrally and inwardly downwardly extending surface 96 as best seen in FIGS. 9 and 10 and substantially flat inwardly downwardly tapered generally triangular shaped sidewalls 98 as best seen in FIG. 8. A sample which can take the form of a small sphere, a short cylindrical pin, a metal shaving, or other relatively small particle, will therefore be, when dropped in the closed hopper means 80, drop downwardly to the intersection of surfaces 96 and 98 and lie along the floor of the hopper defined by the lower portion of walls 96 and 98 and the junction 99 of the jaws.

In the preferred embodiment of the invention, base 30 was made of cast aluminum while jaws 84 and 86 and remaining elements of the hopper means 80 were machined from stainless steel. Naturally, fixed jaw member 84 could be integrally formed with block 30 if it were desired to make this structure of the same material. In the preferred embodiment also, a U-shaped stainless steel leaf spring 100 (FIG. 9 only) is mounted over the upper surface 83 of fixed jaw member 84 with a pair of legs overlying ears 92 and 94 of bracket 90 to hold movable jaw member 86 downwardly into the V-shaped recesses 46 and 47 while still permitting jaw member 86 to open.

OPERATION

Figure 5:
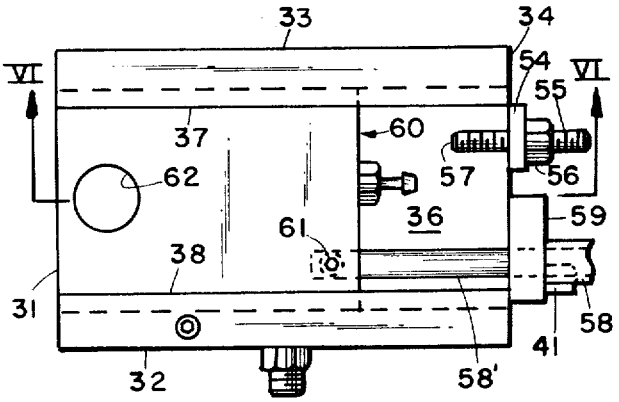
FIG. 5 is a plan view of the sample loading mechanism of the present invention shown in a second position.

The operation of the sample loading mechanism can best be understood by reference to FIGS. 2, 3, and 9 showing the system in a sample receiving and holding position, and FIGS. 5, 6, and 10 showing the system in a sample dropping position. In the position shown in FIGS. 2, 3, and 9 the movable slide 60 is in its retracted position such that the funnel-shaped aperture 62 aligns directly above the open mouth of the hopper means 80 defined by the walls 96 and 98 of the jaws. In this position, rod 45 is retracted such that the weight of jaw 86 acting around pivot points 93 will cause it to remain in a closed position. A sample is then dropped into opening 62 and into the hopper where it rests on the floor of the hopper along junction 99 of the adjacent sidewalls. Next, slide 60 is moved to a forward position as shown in FIG. 5 by the actuation of cylinder 58 such that the piston seal 66 will be positioned over the hopper means as shown in FIG. 6. Air pressure is then applied to fitting 70 through a suitable control valve forcing the piston downwardly into sealing engagement with the upper surface 36 of base 30. With the sample in position in the hopper and the upper end of the hopper effectively sealed by piston 66, the sample can then be dropped into the crucible 12 (FIG. 1) through conduit 22 by the actuation of cylinder 41 extending rod 45 to the position shown in FIG. 10. This pivots jaw 86 outwardly away from fixed jaw 84, permitting the specimen to drop through the funnel-shaped aperature 44 and into conduit 22, thence into the crucible 12. During operation of the furnace to combust a sample, carrier gas from conduit 45 is applied through conduit 43 (FIG. 8) and aperture 43' (FIGS. 9 and 10) downwardly through the open jaw member and into the combustion crucible to provide a carrier gas stream for by-products for combustion which are exhausted through conventional conduits formed in the lower electrode structure of the furnace.

Once an analysis is completed, rod 45 is retracted allowing hopper jaw 86 to swing closed, air pressure on fitting 70 is relieved to permit the slide 60 to be moved rearwardly, and cylinder 58 is actuated to retract the slide positioning this system as shown in FIG. 3 to await the admission of a new sample.

Various modifications to the preferred embodiment of the invention can be made. Thus for example, it may be desired to provide spring loaded closing of movable jaw member 86 or to pivotally couple the end of control rod 45 to the movable jaw 86 and provide a double acting control cylinder 41 therefore. These and other modifications to the preferred embodiment of the invention will be apparent to those skilled in the art and will fall within the spirit and scope of the invention as defined by the appended claims.

The embodiments of the invention in which an exclusive property or privilege is claimed are defined as follows.

1. An apparatus for dropping a relatively small sample into a crucible of a combustion furnace comprising:

hopper means having a floor for releasably holding a relatively small sample, said hopper means including an element movable between a first position closing said floor for holding a sample in said hopper and a second position opening said floor for releasing a sample;

actuating means coupled to said movable element for moving said element between said first and second positions;

a base adapted to be mounted to a combustion furnace and including a generally vertically extending aperture means for receiving said hopper means, and means for coupling said hopper means to said base such that samples can be placed in said hopper means, and further including means coupled to said base for selectively sealing an upper end of said aperture means, wherein said movable element of said hopper comprises a jaw pivotally movable from a closed to an open position, wherein said jaw is pivotally coupled to said base and wherein said actuating means comprises a control rod movably coupled to said base and coupled to said jaw for moving said jaw to at least said open position, said hopper further including a stationary jaw and wherein said stationary jaw and said first named jaw include downwardly and inwardly converging sidewalls to position a sample placed in said hopper on the floor of said hopper; and wherein said sealing means comprises a plate slideably positioned on an upper surface of said base and including an aperture extending vertically therethrough to align with said hopper when said plate is in a first position, said plate further including a seal which is aligned over and sealably engages a top surface of said base around said aperture when said plate is in a second position.

2. The apparatus as defined in claim 1 wherein said seal comprises a piston movably mounted in said plate for movement toward and away from said base, said piston having a top surface with an O-ring seal mounted thereto for engaging said top surface of said base with said O-ring seal surrounding said aperture means, and means for actuating said piston to compress said O-ring seal against said top surface of said base.

3. In a combustion furnace for the combustion of a sample into constitute gasses, including an apparatus for the dropping of a sample into a combustion crucible said apparatus comprising:

a base mounted to said furnace and including a generally vertically extending aperture aligned with respect to a crucible used in connection with said furnace;

a sample holding and releasing hopper mounted to said base and aligned with respect to said aperture, said hopper having a movable jaw for dropping a sample from said hopper into the crucible;

means for actuating said movable jaw to release a sample held therein to drop the sample into a crucible; and means coupled to said base for selectively sealing an upper end of said aperture comprising a plate slideably positioned on an upper surface of said base and including an aperture extending vertically therethrough to align with said hopper when said plate is in first position, said plate further including a seal which is aligned over and sealably engages a top surface of said base around said aperture when said plate is in a second position.

4. In a combustion furnace for the combustion of a sample into constitute gasses, including an apparatus for the dropping of a sample into a combustion crucible said apparatus comprising:

a base mounted to said furnace and including a generally vertically extending aperture aligned with respect to a crucible used in connection with said furnace;

a sample holding and releasing hopper mounted to said base and aligned with respect to said aperture, said hopper having a movable jaw for dropping a sample from said hopper into the crucible;

means for actuating said movable jaw to release a sample held therein to drop the sample into a crucible, wherein said hopper is positioned within said aperture of said base and said movable jaw opens the bottom of said hopper to release and drop a sample therefrom and, said hopper includes downwardly and inwardly converging walls for positioning a sample placed therein centrally at the bottom of said hopper, said movable jaw is pivotally coupled to said base and said actuating means comprises a control rod movably coupled to said base and coupled to said movable jaw for moving said movable jaw to at least an open position for releasing a sample from said hopper; and means coupled to said base for selectively sealing an upper end of said aperture wherein said sealing means comprises a plate slideably positioned on an upper surface of said base and including an aperture extending vertically therethrough to align with said hopper when said plate is in first position, said plate further including a seal which is aligned over and sealably engages a top surface of said base around said aperture when said plate is in a second position.

5. The apparatus as defined in claim 4 wherein said seal comprises a piston movably mounted in said plate for movement toward and away from said base, said piston having a top surface with an O-ring seal mounted thereto for engaging said top surface of said base with said O-ring seal surrounding said aperture means, and means for actuating said piston to compress said O-ring seal against said top surface of said base.

6. A combustion furnace for use with an analyzer, said furnace including sample loading means for dropping a relatively small sample into a crucible positioned in the combustion furnace comprising:

a combustion furnace including a combustion chamber with means for supporting therein a crucible having an upwardly extending open mouth;

hopper means for releasably holding a sample, said hopper means including a jaw pivotally movable from a first position for holding a sample in said hopper means and a second position for releasing a sample;

actuating means coupled to said movable element for moving said element between said first and second positions;

means for mounting said hopper means in communication with said combustion chamber for dropping a sample into a crucible positioned within said combustion chamber;

a base mounted to said combustion furnace and including a generally vertically extending aperture and means for mounting said hopper means to said base within said aperture, wherein said jaw is pivotally coupled to said base and wherein said actuating means comprises a control rod movably coupled to said base and coupled to said jaw for moving said jaw to at least said open position; and means coupled to said base for selectively sealing an upper end of said aperture, wherein said sealing means comprises a plate slideably positioned on an upper surface of said base and including an aperture extending vertically therethrough to align with said hopper when said plate is in a first position, said plate further including a seal which is aligned over and sealably engages a top surface of said base around said aperture when said plate is in a second position.

7. The apparatus as defined in claim 6 wherein said seal comprises a piston movably mounted in said plate for movement toward and away from said base, said piston having a top surface with an O-ring seal mounted thereto for engaging said top surface of said base with said O-ring seal surrounding said aperture means, and means for actuating said piston to compress said O-ring seal against said top surface of said base.

8. The apparatus as defined in claim 7 wherein said combustion furnace is a resistance furnace and said means for supporting a crucible comprises an electrode.

* * * * *